United States Patent [19]

Goettl

[11] 4,400,185

[45] Aug. 23, 1983

[54] EVAPORATIVE COOLER WITH IMPROVED AIR HANDLING MECHANISM

[76] Inventor: Adam D. Goettl, 4960 E. Palomino Rd., Phoenix, Ariz. 85018

[21] Appl. No.: 381,383

[22] Filed: May 24, 1982

Related U.S. Application Data

[63] Continuation of Ser. No. 211,132, Nov. 28, 1980, abandoned.

[51] Int. Cl.[3] ..... B01F 3/04

[52] U.S. Cl. ..... 55/257 C; 261/29; 261/106

[58] Field of Search ..... 261/29, 106; 55/257 C

[56] References Cited

U.S. PATENT DOCUMENTS

| | | | |
|---|---|---|---|
| 1,782,928 | 11/1930 | Knowlson | 261/29 |
| 1,918,431 | 7/1933 | Seator | 261/29 |
| 1,951,962 | 3/1934 | Baum | 261/29 |
| 2,121,278 | 6/1938 | Babcock | 261/106 |
| 2,156,879 | 5/1939 | Slater | 261/106 |
| 2,267,835 | 12/1941 | Norris | 261/30 |
| 2,620,722 | 12/1952 | Owens | 261/29 |
| 2,732,190 | 1/1956 | Mart | 261/30 |
| 3,081,987 | 3/1963 | Meek et al. | 261/DIG. 11 |
| 3,166,610 | 1/1965 | Cole | 261/29 |
| 3,322,405 | 5/1967 | Knudson et al. | 261/106 |
| 3,337,196 | 8/1967 | McCoy et al. | 261/29 |
| 3,500,615 | 3/1970 | Meek | 261/DIG. 11 |
| 3,637,194 | 1/1972 | Swimmer et al. | 261/29 |
| 3,867,486 | 2/1975 | Nagele | 261/106 |
| 3,936,515 | 2/1976 | Barreto | 261/29 |

*Primary Examiner*—Tim R. Miles

*Attorney, Agent, or Firm*—Herbert E. Haynes, Jr.

[57] ABSTRACT

A fan-type evaporative cooler having an improved air handler assembly which locates the rotational path of the fan remotely from the air delivery outlet so that an open mesh grill may be safely used in the air delivery outlet opening, and the improved air handler includes a moisture extraction baffle which protects the internal and external workings of the fan drive motor from corrosion and mineral deposits.

9 Claims, 6 Drawing Figures

EVAPORATIVE COOLER WITH IMPROVED AIR HANDLING MECHANISM

CROSS-REFERENCE TO RELATED APPLICATION

This is a continuation application of copending U.S. Patent Application, Ser. No. 211,132, filed Nov. 28, 1980, now abandoned, for: EVAPORATIVE COOLER WITH IMPROVED AIR HANDLING MECHANISM, by the same inventor.

BACKGROUND OF THE INVENTION

1. Field of the Invention

This invention relates in general to evaporative coolers and more particularly to an evaporative cooler having an improved fan-type air handling mechanism.

2. Description of the Prior Art

For many years, evaporative coolers have been used as an economical way to supply cooled air to commercial and residential buildings.

Briefly, evaporative coolers normally include a four sided cabinet structure having loosely packed wettable fibrous pads, most often of excelsior, mounted in the sides thereof. The bottom of the cabinet serves as a sump, or reservoir, for water which is pumped through a suitable plumbing system to the upper part of the cabinet and is distributed to the tops of the fibrous pads for wetting thereof. The water trickles down through the pads under the influence of gravity and returns to the sump for recirculation. An air handler mechanism is mounted within the cabinet which operates to draw ambient air into the cabinet through the wet fibrous pads so that the air is cooled by the well known evaporation principle. The air handler mechanism is connected to an outlet opening formed in the side of the cabinet so that the evaporatively cooled air is directed exteriorly of the cabinet for delivery either directly to a point of use or to a distribution duct network for delivery to plural points of use.

Evaporative coolers are normally fabricated in either of two basic configurations namely, downdraft and sidedraft models. A downdraft evaporative cooler has its evaporatively cooled air outlet opening formed in the bottom of the cabinet which allows mounting of a wettable fibrous pad in each side of the cabinet. Downdraft evaporative coolers are ideally suited for roof top mounting. A sidedraft evaporative cooler is ideally suited for mounting on a vertical wall for horizontal delivery of the evaporatively cooled air such as through a wall via a hole especially formed for that purpose or through a window. Sidedraft units are configured with their evaporatively cooled air outlet opening in one of the sides of the cabinet with the remaining sides having the fibrous pads mounted therein.

The air handling function in evaporative coolers is accomplished in two ways, either by use of a centrifugal blower assembly or a fan, with engineering considerations, economics, and the like being the factors which determine which of these mechanisms is to be used.

The present invention relates to improvements in fan-type evaporative coolers, therefore, this discussion will be limited to that type of structure. The fan-type air handler mechanism in prior art evaporative coolers typically includes a suitable electric motor mounted within the cooler cabinet so that the motor is in axial alignment with the evaporatively cooled air outlet opening. A multi-blade fan is mounted fast on the motor's shaft with the fan being immediately adjacent the air outlet opening, and a grill or air directing louver assembly is mounted in the air outlet opening.

These fan-type evaporative coolers have been commercially successful for many years and, aside from corrosion and mineral deposition problems which are inherent in all evaporative cooler structures, they have been relatively problem and trouble free.

Recently however, regulatory agencies concerned with consumer product safety have dictated that the grills which are mounted in the air delivery outlet opening of these fan-type evaporative coolers be of a mesh which is small enough to prevent a person's fingers from passing through the grill into the path of the rotating fan. This regulation has resulted in a decrease in the operating efficiency of the evaporative coolers in that grills small enough to keep a child's finger out of the path of the fan cause a restriction, or backpressure, which decreases the air flow through the evaporative cooler. Such a decrease in air flow through the evaporative cooler causes an increased load on the electric fan drive motor which results in increased heating of the motor and higher operating costs. Further, with less air being delivered due to the restricted air flow, less cooling at the point of use results.

Attempts have been made to solve this problem by increasing the size of the electric motor and/or fan and this has not proven to be an efficient method for moving air due to increased initial and operating costs, and is further undesirable due to an increase in noise.

As hereinbefore mentioned, and as is well known in the art, all evaporative coolers, including those of the fan-type, suffer from corrosion and mineral deposition, or scaling, problems. The water used to wet the fibrous pads inherently contains minerals such as calcium chloride and other impurities, and the mineral concentration in the water will increase as a result of the evaporation process. As the water is recirculatingly pumped from the sump or floor pan of the cooler cabinet to the pads, the unevaporated water returns to the sump resulting in a mineral concentration increase in the water reservoir. As the mineral concentration increases, the rate of precipitation will also increase, and ambient air being drawn into the cooler will entrain some of the water and deposit the minerals on every surface and component within the cooler cabinet. The mineral disposition, or scaling, problem is most serious with regard to what it does to the electric motor which drives the air handler. Deposited calcium chloride and other salts are deposited on the wiring, terminals, motor shaft and bearings, and when open or unsealed motors are used, the minerals are deposited on the windings and other internal workings of the motor. These deposited minerals are hygroscopic and have a moist pasty character when the evaporative cooler is operating and will often be in such a state even when the evaporative cooler is not operating due to its inherent tendency to attract moisture from the atmosphere. As a result of the hygroscopic nature of the deposited minerals, shorting out of the motors is an all to frequent occurance.

Therefore, a need exists for a new and improved fan-type evaporative cooler which overcomes some of the problems and shortcomings of the prior art.

SUMMARY OF THE INVENTION

In accordance with the present invention, a new and improved fan-type evaporative cooler is disclosed which, in addition to the usual evaporative cooler components, includes a novel fan-type air handling assembly.

The fan-type evaporative cooler of the present invention includes the usual components of a cooler cabinet having an air delivery outlet opening formed in one surface thereof and wettable fibrous pads mounted in at least one of its sides. The floor pan of the cooler cabinet serves as a sump or reservoir for water which is pumped through a water distribution plumbing network to the tops of the fibrous pads for wetting thereof. The water trickles down through the pads and the unevaporated water returns under the influence of gravity to the floor pan for recirculation. The water level in the floor pan is kept at a predetermined level by a float operated valve which supplies makeup water thereto from a suitable source such as a domestic water supply line.

Ambient air is drawn through the wet fibrous pads into the interior of the cooler cabinet due to a negative static pressure therein caused by operation of the fan-type air handler, and the air entering the cooler cabinet will be cooled by evaporation in the well known manner.

The novel air handler of the present invention includes a fan shroud having a circular air inlet end with the endless sidewall divergingly extending therefrom and terminating in an enlarged air outlet end. The air outlet end of the fan shroud is attached to the interior of the cabinet so as to be coaxial with the air delivery outlet opening formed in the cooler cabinet. By mounting the fan shroud in this manner, it extends into the cabinet to locate the circular air inlet thereof well within the cabinet. A suitable electric motor is mounted axially within the fan shroud and is oriented so that its output shaft is proximate the air inlet opening of the shroud. A multi-blade fan is carried on the motor's output shaft and will thus be rotatably driven in a path adjacent the air inlet end. In this manner, the rotational path of the multi-blade fan will be set back from the air delivery outlet opening of the cooler cabinet a distance which is at least somewhat greater than the length of the fan drive motor. This set back positioning of the fan allows the use of a relatively open mesh grill in the air delivery outlet opening of the evaporative cooler, with the only restriction as to the mesh size being that it must be small enough to prevent a person's hand from passing therethrough. Therefore, the novel fan-type air handler assembly of the present invention overcomes the air flow back-pressuring problem of the prior art.

The prior art problem of mineral deposition, as it relates to the electric fan drive motors is overcome, or at least substantially reduced in the evaporative cooler of the present invention by a moisture extraction baffle which is mounted between the motor housing and the multi-blade fan. The moisture extraction baffle may be carried on the motor's output shaft or may be mounted in the desired position by a suitable mounting bracket attached to the fan shroud. In any event, the air moving through the fan shroud will impinge on the baffle so that free moisture carried by the air will be deposited on the baffle and is thereby extracted from the air and this eliminates, or at least substantially reduces the occurance of mineral deposition on and in the motor, and on the motor's components which could otherwise be damaged by such deposition.

Accordingly, it is an object of the present invention to provide a new and improved fan-type evaporative cooler.

Another object of the present invention is to provide a new and improved fan-type evaporative cooler which eliminates the air flow backpressure problem in such structures resulting from the safety requirement that relatively small mesh grills be mounted in the air delivery outlet opening of the cooler cabinet.

Another object of the present invention is to provide a new and improved fan-type evaporative cooler which eliminates, or at least substantially reduces, mineral deposition on the exterior and interior workings of the electric fan drive motor.

Another object of the present invention is to provide a new and improved evaporative cooler having a novel fan-type air handler assembly which locates the rotational path of the fan a substantial distance from the air delivery outlet opening of the cooler cabinet to allow the use of a relatively large mesh grill in that opening.

Another object of the present invention is to provide a new and improved fan-type evaporative cooler wherein the novel fan-type air handler assembly includes a fan shroud mounted so as to extend coaxially from the air delivery outlet opening of the cooler into the interior thereof to locate the air inlet end of the fan shroud in a set back relationship with respect to the air delivery outlet opening, and an electric fan drive motor mounted axially within the fan shroud so that it drives a multi-blade fan in a rotational path proximate the air inlet opening of the fan shroud.

Still another object of the present invention is to provide a new and improved fan-type evaporative cooler of the above described character wherein the novel fan-type air handler assembly further includes a moisture extraction baffle means mounted between the motor housing and the fan to extract free moisture from the air prior to its movement into the vicinity of the motor to eliminate, or at least substantially reduce, the occurrence of mineral deposition.

The foregoing and other objects of the present invention, as well as the invention itself, may be more fully understood from the following description when read in conjunction with the accompanying drawings.

DESCRIPTION OF THE PREFERRED EMBODIMENTS

Figure 1:
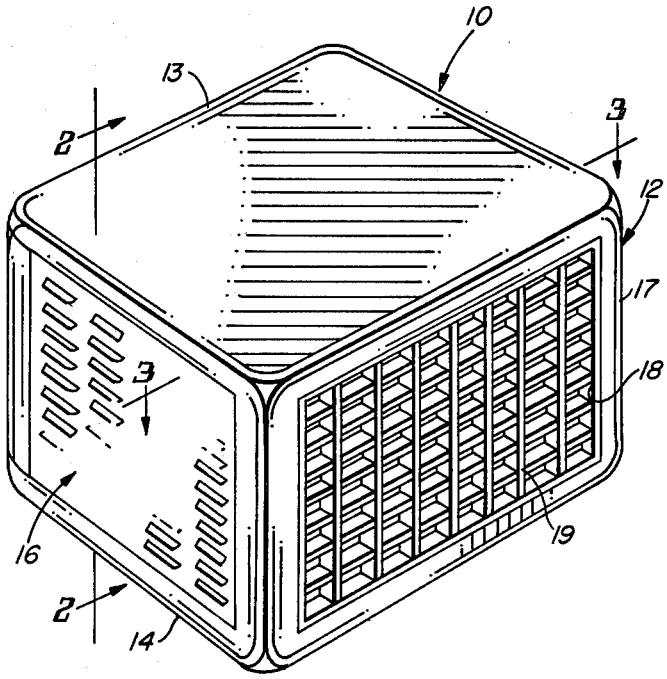
FIG. 1 is a perspective view of the new and improved fan-type evaporative cooler of the present invention.
Figure 2:
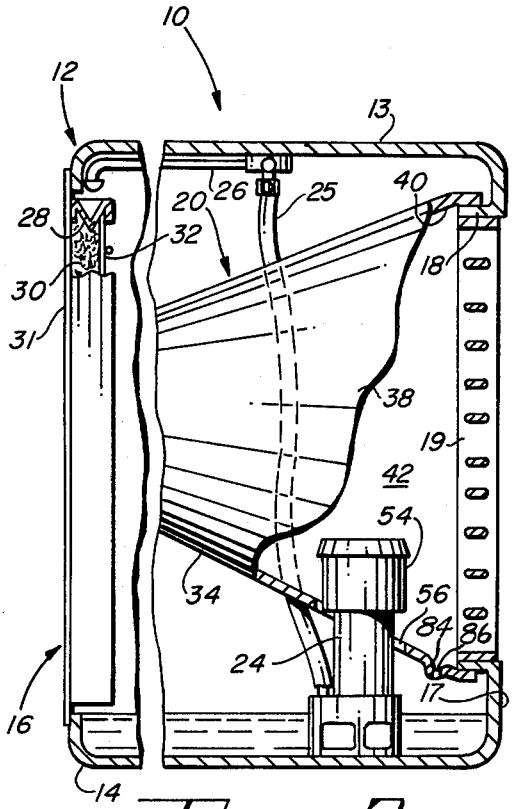
FIG. 2 is an enlarged fragmentary sectional view taken along the line 2—2 of FIG. 1.
Figure 3:
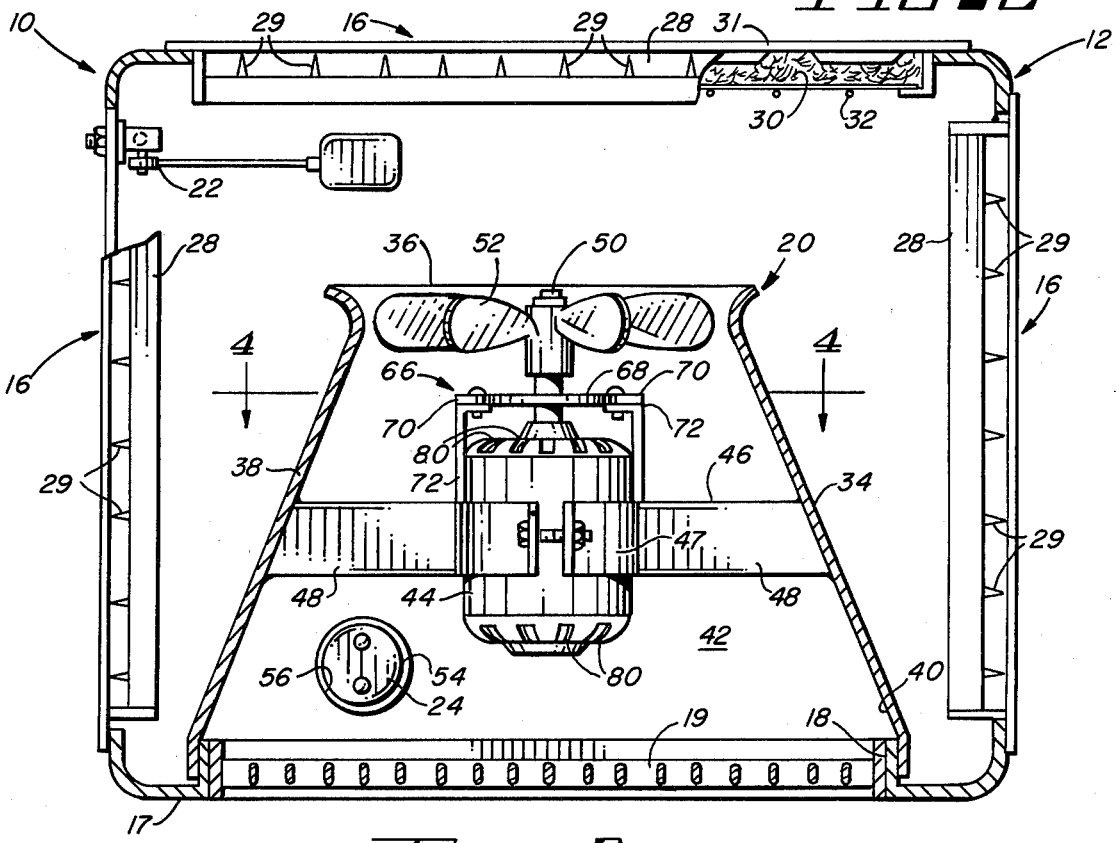
FIG. 3 is an enlarged sectional view taken along the line 3—3 of FIG. 1.

Referring more particularly to the drawings, FIGS. 1, 2 and 3 illustrate the improved fan-type evaporative cooler of the present invention which is indicated in its entirety by the reference numeral 10. The evaporative cooler 10 includes a cabinet 12 formed with the usual inverted top pan 13 and a bottom or sump pan 14, with the top and bottom pans being suitably interconnected to provide the cabinet with three open sides in which cooler pad assemblies 16 are demountably mounted in the usual manner well known in the art. The remaining side 17 of the cooler cabinet is formed so as to provide an air delivery outlet opening 18 having a grill means 19 therein as will hereinafter be described in detail.

The particular evaporative cooler 10 shown in the drawings is of the type known as a "sidedraft" model in which the air delivery outlet opening is located in the side of the cooler. Sidedraft coolers are ideally suited for mounting in a building wall, window, or otherwise, when horizontal air delivery is desired. Another type of commonly used evaporative cooler is known as a "downdraft" model in that the air delivery outlet opening is located in the bottom of the cooler cabinet, and downdraft coolers are usually employed for rooftop mounting. In view of these two types of evaporative coolers, it will be understood that the following description of the sidedraft cooler 10 is not intended as a limitation, in that the principles of the present invention can be applied to downdraft coolers as well.

In any event, all evaporative coolers are equipped with similar components and operate in the same basic manner which will now be briefly described.

All evaporative coolers are provided with some form of air handler assembly which in the evaporative cooler 10 of the present invention is a fan-type air handler 20 which will hereinafter be described in detail. The air handler assembly 20 is located in the interior of the cooler cabinet 12 and when it is operating will exhaust air out of the cabinet through the air delivery outlet opening 18. This creates a negative static pressure in the cooler cabinet 12 which results in ambient air moving into the cabinet through the cooler pad assemblies 16. The air moving into the cabinet 12 through the pads is cooled by the evaporation principle due to the pads being wet, and this evaporatively cooled air is drawn into the fan-type air handler assembly 20 and delivered through the air delivery outlet opening 18 to a point of use.

The floor pan 14 serves as a reservoir or sump for water which is employed for wetting of the cooler pad assemblies 16. The water is initially supplied to the floor pan 14 by means of a float operated valve 22 which is connected by any suitable source of water (not shown) such as a domestic water supply line. In addition to initially supplying water to the floor pan, the valve 22 maintains the water level in the pan 14 at a predetermined level by supplying make-up water as needed to replace that lost by evaporation.

A suitable pump 24 is employed to pump the water through a tube 25 to a water distribution plumbing network 26 located in the upper part of the cabinet 12. The plumbing network 26 distributes the water to the top of each of the cooler pad assemblies 16. The pad assemblies normally include a V-shaped trough 28 which extends along the top thereof with slots 29 formed in equally spaced increments therethrough for distributing the water evenly across the tops of the pads. The pad assemblies 16 include a loosely packed fibrous pad 30, usually excelsior, which is supported in a frame which includes a louvered face plate 31 and a wire grill 32. The water flows downwardly through the pad assemblies 16 under the influence of gravity and the excess water, i.e. the amount not evaporated, will fall from the pad assemblies into the floor pan 14 and will be recirculated.

Reference is now made in particular to FIG. 3 wherein the fan-type air handler 20 is best seen. A fan shroud 34, is provided with a circular air inlet opening 36 formed in one end thereof with the endless shroud sidewall 38 divergingly extending from the air inlet opening and terminating in an air outlet opening 40, with the shroud defining an air movement passage 42 therethrough. The fan shroud 34 is fixedly secured, such as by welding, to the inside of the cabinet sidewall 17 so that the air outlet opening 40 of the shroud is in axial communication with the air delivery outlet opening 18 of the cooler cabinet 12.

It will be noted, particularly in FIG. 1, that the air delivery outlet opening 18 of the cooler cabinet 12 is of rectangular configuration which is usually the case in such units. This means that the endless shroud sidewall 38 will have to be configured so that it defines the circular air inlet opening 36 on one end and the rectangular air outlet opening on the other end, and this may be accomplished in accordance with techniques well known in the sheet metal art.

The above described mounting of the fan shroud 34 physically locates the air inlet opening 36 thereof well within the cooler cabinet 12 at a remote and substantial distance from the air delivery outlet opening 18 of the cabinet.

A suitable electric motor 44 is mounted within the fan shroud 34 so as to lie along the axis of the air movement passage 42, with such mounting being accomplished by a suitable bracket means 46. The bracket means 46 may include a circular clamp 47 in which the housing of the motor 44 is circumscribingly held, with the clamp being secured to the inner surface of the endless shroud sidewall 38 by radial struts 48 which are welded or otherwise secured to both the clamp 47 and the shroud sidewall 38.

The electric motor 44 has the usual output shaft 50, and the motor is oriented so that the shaft extends therefrom toward the air inlet opening 36 of the fan shroud 34. A multi-blade fan 52 is mounted fast on the motor output shaft 50 so that the fan will be driven in a rotating path proximate the air inlet opening 36 of the fan shroud. The multi-blade fan 52 operates to draw air from the interior of the cooler cabinet 12 and move it through the air movement passage 42 of the shroud 34 to the air delivery outlet opening 18 of the cabinet 12.

From the above, it will be seen that the multi-blade fan 52 is located a considerable distance from the air delivery outlet opening 18 of the cooler cabinet 12, with the minimum distance being somewhat greater than the length of the motor 44. Therefore, the grill means 19 which is mounted in the air delivery outlet opening 18 and is demountable for servicing of the cooler components, may be of a relatively large mesh in that entry of a person's finger or fingers through the grill is not a safety hazzard. The openings of the grill means 19 should however be sized to prevent a person from passing his hand through the grill, and with such sizing, air flow through the fan-type evaporative cooler 10 will encounter relatively little backpressure from the grill means 19.

It should be noted that the grill means 19 may be any conventionally used structure such as a simple wire mesh, air directing louver assembly, and the like.

Since evaporatively cooled air will move under pressure through the air movement passage 42 of the fan shroud 34, the pump 24 is preferably mounted, as shown best in FIG. 2, so that the air will cool the electric motor 54 which drives the pump. This is accomplished by simply providing a suitable hole 56 in the endless shroud sidewall 38 so that the motor 54 of the pump extends through the hole at least part way into the fan shroud.

Figure 6:
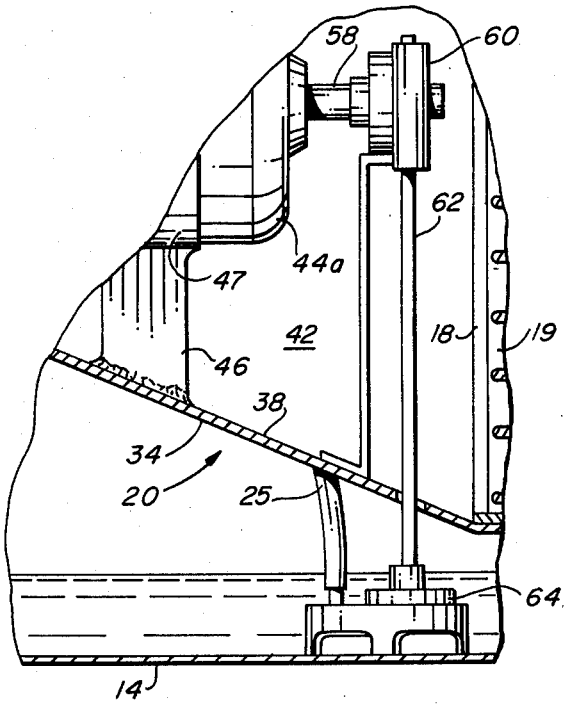
FIG. 6 is a fragmentary sectional view similar to FIG. 2 and illustrating a modification of the fan-type evaporative cooler of the present invention.

An alternate pump arrangement is shown in FIG. 6 wherein the electric motor 44*a*, which drives the multi-blade fan 52, is of the double-shaft type. In addition to the output shaft 50 (FIG. 3), the motor 44 has a second rearwardly extending output shaft 58. The shaft 58 is coupled by means of a suitable gear box 60 to drive a shaft 62 which is connected so that it in turn drives the pump 64 which is located in the floor pan 14 of the cooler cabinet 12 below the water level. In this manner, a single electric motor 44*a* is employed to drive both the fan 52 and the pump 64.

Figure 4:
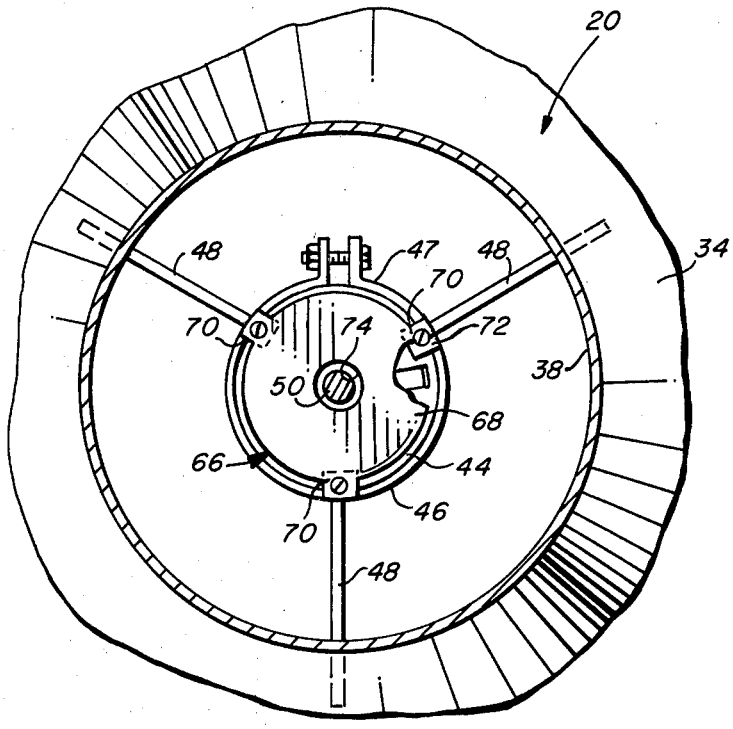
FIG. 4 is an enlarged fragmentary sectional view taken along the line 4—4 of FIG. 3 and illustrating a first embodiment of the moisture extraction baffle means which forms part of the novel fan-type air handler of the evaporative cooler of the present invention.

Referring once again to FIG. 3, and to FIG. 4, the fan-type air handler 20 is seen to include a moisture extraction baffle means 66. The baffle is in the form of a flat disc-shaped plate 68 which is positioned between the motor 44 and the multi-blade fan 52. The baffle 66 may be mounted in any suitable manner such as by forming the disc-shaped baffle plate 68 with radially extending ears 70 which are attached, such as by screws, to the folded over extending ends of support arms 72 that are fixedly mounted on the clamp 47 of the motor support bracket means 46. Thus, the baffle plate 68 is fixedly mounted and is provided with a central aperture 74, FIG. 4, through which the motor's output shaft 50 freely passes.

Figure 5:
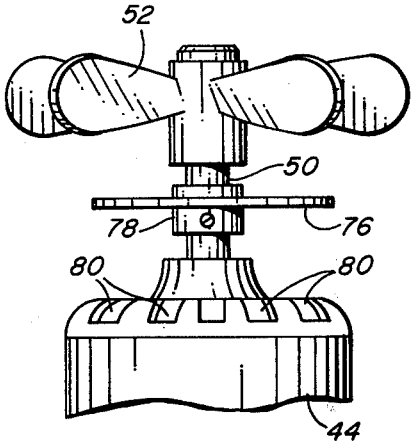
FIG. 5 is a fragmentary plan view illustrating the fan drive motor and multi-blade fan having a second embodiment of the moisture extraction baffle means mounted therebetween.

An alternate and preferred embodiment of the moisture extraction baffle means is shown in FIG. 5 with this embodiment including a disc-shaped plate 76 having a central hub 78 by which the plate is attached to the output shaft 50 of the motor 44 for rotation therewith.

In either case, the air moving through the air movement passage 42 of the fan shroud 34 will impinge on the moisture extraction baffle means. The air emerging from an evaporative cooler will inherently contain moisture some of which is merely carried along by the air in the form of what may be called free moisture. This air will be deflected by the baffle means with the free moisture being deposited thereon due to its tendency to resist changes in its movement path. Thus, the air from which the free moisture has been extracted will pass proximate the electric motor 44, and will pass through the air cooling slots 80 of the motor if it is of the open or unsealed type, and this air will cool the electric motor with no, or at least minimum mineral deposition. The moisture deposited on the baffle means will fall, or otherwise be deflected such as by a slinging action in the case of the baffle means 76, onto the interior surface of the fan shroud 34 and will exit therefrom through a collection trough 84 having drain holes 86 (one shown) formed therein as seen in FIG. 2.

While the principles of the invention have now been made clear in illustrated embodiments, there will be immediately obvious to those skilled in the art, many modifications of structure, arrangements, proportions, the elements, materials, and components used in the practice of the invention, and otherwise, which are particularly adapted for specific environments and operation requirements without departing from those principles. The appended claims are therefore intended to cover and embrace any such modifications within the limits only of the true spirit and scope of the invention.

What I claim is:

1. A fan-type evaporative cooler comprising:

(a) an evaporative cooler including a cabinet having an air delivery outlet opening;

(b) a fan shroud having an endless sidewall which defines an air movement path between an air inlet of circular configuration formed in one end thereof and an axially aligned air outlet formed in the other end, said fan shroud divergingly extending from the air inlet to the air outlet to define an area of minimum cross section, said fan shroud being mounted entirely within the cabinet of said evaporative cooler so that the air outlet is in communication with the air delivery outlet opening of the cabinet and the air inlet remote therefrom;

(c) an electric motor mounted within said fan shroud so as to lie on the axis of the air movement path defined by said fan shroud, said electric motor having an output shaft which extends axially from said motor toward the air inlet of said fan shroud; and (d) a multi-blade fan mounted on the output shaft of said electric motor concentrically in an area of minimal cross section of said fan shroud.

2. A fan-type evaporative cooler as claimed in claim 1 and further comprising grill means mounted in the air delivery outlet opening of the cabinet of said evaporative cooler, said grill means having a large mesh to minimize back pressuring of the air flow through said fan shroud with the maximum size of the mesh being such that a person's hand will be prevented from passing through said grill.

3. A fan-type evaporative cooler as claimed in claim 1 wherein the air inlet opening and the air outlet opening of said fan shroud are spaced from each other a distance which is at least equal to the length of said electric motor.

4. A fan-type evaporative cooler as claimed in claim 1 and further comprising moisture extraction baffle means mounted between said electric motor and said multi-blade fan for extracting free moisture from the air movable through said fan shroud.

5. A fan-type evaporative cooler as claimed in claim 4 wherein said moisture extraction baffle means comprises:

(a) a flat plate;

(b) means for fixedly mounting said flat plate between said electric motor and said multi-blade fan; and (c) said flat plate having a central aperture formed therethrough through which the output shaft of said electric motor freely extends.

6. A fan-type evaporative cooler as claimed in claim 4 wherein said moisture extraction baffle means comprises a flat plate having a central hub fixedly carried on the output shaft of said electric motor for rotation therewith.

7. A fan-type evaporative cooler as claimed in claim 1 and further comprising:

(a) said evaporative cooler having a floor pan formed in the cabinet thereof which serves as a water reservoir;

(b) an upstanding pump in said floor pan and having a drive motor on its uppermost end; and (c) said fan shroud having a hole formed through the endless sidewall thereof with the motor of said pump extending at least part way through that hole into the air movement path defined by said fan shroud.

8. A fan-type evaporative cooler as claimed in claim 1 and further comprising:

(a) said evaporative cooler having a floor pan formed in the cabinet thereof which serves as a water reservoir;

(b) a pump in the floor pan of said evaporative cooler;

(c) said electric motor having a second output shaft extending oppositely and axially therefrom; and (d) means for coupling the second output shaft of said electric motor to said pump for driving thereof.

9. In an evaporative cooler including a housing having a side wall within which an outlet opening is formed, a grill mounted within the outlet opening substantially coplanar with the side wall, a discharge duct having axially spaced inlet and outlet portions, and blower means for inducing discharge flow through the duct having a motor and a bladed fan connected to the motor, the improvement residing in said grill having a protective mesh size resisting the discharge flow through the outlet opening to create a predetermined back pressure, means mounting the motor downstream of the fan for positioning of the fan within the duct at the inlet portion thereof, and means mounting the outlet portion of the duct internally of the housing on the side wall and at the outlet opening for support of the duct entirely within the housing thereby positioning the fan in spaced alignment with the outlet opening upstream of the motor, said duct enclosing passage means diverging in a downstream direction from the fan to compensate for said predetermined back pressure created by the flow resistance of the grill.

* * * * *